United States Patent [19]

Nakamura et al.

[11] Patent Number: 4,583,518

[45] Date of Patent: Apr. 22, 1986

[54] SPACER STRUCTURE FOR HEATING APPLIANCE

[75] Inventors: Kazuharu Nakamura, Nagoya; Yutaka Nakanishi, Kounan; Junzi Mizuno, Nagoya, all of Japan

[73] Assignee: Toyotomi Kogyo Co., Ltd., Aichi, Japan

[21] Appl. No.: 659,820

[22] Filed: Oct. 11, 1984

[30] Foreign Application Priority Data

Oct. 11, 1983 [JP] Japan ..... 58-157926[U]

[51] Int. Cl.[4] ..... F24C 15/36

[52] U.S. Cl. ..... 126/201; 126/92 B; 219/342

[58] Field of Search ..... 126/42, 92 R, 92 A, 126/92 AC, 92 B, 92 C, 93, 96, 97, 203, 201, 214, 114; 219/342, 347

[56] References Cited

U.S. PATENT DOCUMENTS

| | | | |
|---|---|---|---|
| 4,314,543 | 2/1982 | Bullington et al. | 126/201 |
| 4,440,147 | 4/1984 | Amano et al. | 126/201 |
| 4,474,166 | 10/1984 | Shaftner et al. | 126/96 |
| 4,483,313 | 11/1984 | Kojima et al. | 126/92 R |

*Primary Examiner*—Margaret A. Focarino

*Attorney, Agent, or Firm*—Pollock, Vande Sande & Priddy

[57] ABSTRACT

A spacer structure for a heating appliance is disclosed which is capable of allowing the package of the heating appliance to be significantly simplified and small-sized to reduce the cost and is simple in construction. The spacer structure includes a spacer formed into a substantially U-shape and having a pair of inward bent ends and projections provided at the inward bent ends which are fitted in through-holes of a mushroom shape to rotatably securely connect the spacer to the heating appliance.

12 Claims, 5 Drawing Figures

SPACER STRUCTURE FOR HEATING APPLIANCE

BACKGROUND OF THE INVENTION

1. Field of the Invention

This invention relates to a spacer structure for a heating applicance and more particularly to a spacer structure for a heating appliance which is adapted to space the heating appliance at a suitable or safe distance from a combustible material such as furniture, a wall of a house or the like when it is approached thereto unconsciously or by mistake.

2. Description of the Prior Art

Conventionally, the spacing of a heating appliance such as an oil heater, an electric heater or the like from a combustible material such as furniture, a wall of a house or the like has been carried out by forward expanding a protective guard provided at the front face of the heating appliance or substantially extending the periphery of a saucer on which the heating appliance is securely put. However, such conventional spacing has a disadvantage of causing the package of a heating appliance to be complicated and/or large-sized, to thereby cost a great deal.

Thus, it would be highly desirable to develop spacing techniques which is capable of allowing the package of a heating appliance to be simplified and small-sized to significantly reduce the cost.

SUMMARY OF THE INVENTION

The present invention has been made in view of the foregoing disadvantage of the prior art.

Accordingly, it is an object of the present invention to provide a spacer structure for a heating appliance which is capable of allowing the package of the heating appliance to be significantly simplified and small-sized to carry out reduction of the cost and facilitate the transportation and putting away.

It is another object of the present invention to provide a spacer structure for a heating appliance which is capable of positively spacing the heating appliance from a combustible material such as furniture, a wall of a house or the like with a simple construction.

It is a further object of the present invention to provide a spacer structure for a heating appliance which is capable of being manufactured with a low cost.

It is still a further object of the present invention to provide a spacer structure for a heating appliance which is capable of accomplishing the abovedescribed objects without substantially affecting the construction of the heating appliance.

Still other objects and advantages of the invention will in part be obvious and will in part be apparent from the following description.

In accordance with the present invention, there is provided a spacer structure for a heating appliance comprising an outer casing of said heating appliance having a pair of through-holes formed at the lower portions of opposite side walls thereof; a spacer comprising a spacer body formed of a rigid material into a substantially U-shape and formed with a pair of mounting means which are engaged with said through-holes of said outer casing of said heating appliance to rotatably securely mount said spacer to said heating appliance; and a saucer on which said heating appliance is adapted to be securely put, said saucer being formed to have a periphery outward extending from said heating appliance to a degree sufficient to prevent release of the engagement between said mounting means of said spacer and said through-holes of said outer casing when it is attached to said heating appliance.

In accordance with the present invention, there is also provided a spacer structure for a heating appliance comprising an outer casing of said heating appliance having a pair of through-holes formed at the lower portions of opposite side walls thereof into a substantially upright mushroom shape; a spacer comprising a spacer body formed of a rigid wire material into a substantially U-shape and formed with a pair of mounting means which are engaged with said through-holes of said outer casing to rotatably securely mount said spacer to said heating appliance; said mounting means of said spacer comprising inward bent portions formed at both ends of said spacer body so as to be opposite to each other and projections formed at said inward bent portions, the combination of said inward bent portions and projections having a contour corresponding to said through-holes to allow said mounting means to be integrally fitted in said through-holes; and a saucer on which said heating appliance is adapted to be securely put, said saucer being formed to have a periphery outward extending from said heating appliance to a degree sufficient to prevent release of the engagement between said mounting means of said spacer and said through-holes of said outer casing when it is attached to said heating appliance.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which like reference numerals designate like parts throughout; wherein.

DETAILED DESCRIPTION OF THE PREFERRED EMBODIMENT

Now, a spacing or spacer structure for a heating appliance according to the present invention will be described with reference to the accompanying drawings.

Figure 1:
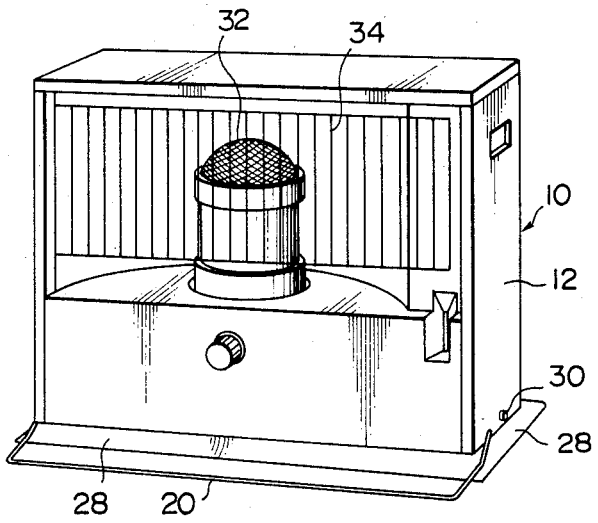
FIG. 1 is a schematic perspective view showing a heating appliance in the form of an oil-fired space heater to which a spacer structure according to the present invention is mounted.
Figure 2:
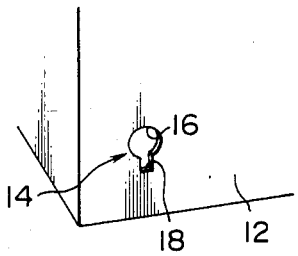
FIG. 2 is a schematic fragmentary perspective view showing a locating through-hole of a substantially mushroom-like shape formed at the lower portion of a side wall of a casing of a heating appliance through which a spacer structure of the present invention is adapted to be detachably mounted to the heating appliance.

FIG. 1 shows a heating appliance having a spacer structure of the present invention mounted thereto. The heating appliance generally designated by reference numeral 10 in FIG. 1 is in the form of an oil fired-space heater of the red-heated type; however, a heating appliance to which a spacer structure of the present invention is to be mounted is not limited to such an oil-fired space heater and may be in the form of an electric heater, a gas heater or the like as long as it has a means for mounting a spacing or spacer structure of the present invention thereto.

The oil-fired space heater 10 includes a casing or housing 12, which has a pair of holes 14 formed therethrough. In the illustrated heating appliance, the through-holes 14 are formed at the lower portions of opposite side walls of the casing 12. In the illustrated embodiment, the through-holes 14 each are formed into a substantially mushroom shape which has a circular portion 16 and a stem portion 18 extending from the circular portion 16. The through-hole 14 is preferably formed into an upright mushroom shape. More particularly, the stem portion 18 is preferably formed to downward extend from the circular portion 16 for the purpose of facilitating the mounting of a spacer 20 described hereinafter to the casing 12 and preventing the unexpected disengagement of the spacer 20 from the heating appliance 10. However, the stem portion 18 may be formed in the different direction as long as such purposes may be effectively carried out. The formation of the through-hole 14 into such a mushroom shape allows the fitting of the spacer 20 into the through-hole 14 to be carried out with a certain directional property.

Figure 3:
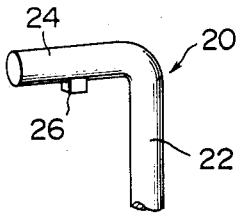
FIG. 3 is a schematic fragmentary enlarged view showing the end portion of a spacer of a spacer structure according to the present invention.

The spacer 20 comprises a spacer body 22 formed of a rigid material such as a metallic or plastic wire or elongated strip into a substantially U-shape of which both ends 24 are inward bent to be opposite to each other. In the illustrated embodiment, the spacer body 22 is formed of a metallic or plastic wire of a circular section, which has a diameter somewhat smaller than that of the circular portion 16 of the through-hole 14 so that it may be fitted in the hole 14. The inward bent ends 24 are adapted to be inserted through the through-holes 14 into the heating appliance 10 to mount the spacer 20 to the appliance 10, as described hereinafter. The spacer 20 has projections 26 formed thereon adjacent to the distal end portions of the inward bent ends 24 thereof, as shown in FIG. 3. The projections 26 each have a shape corresponding to and smaller than that of the stem portion 18 of the through-hole 14, and are provided so as to correspond in position to the stem portions 18 of the through-holes 14. The engagement between the spacer 20 and the through-holes 14 of the casing 12 of the heating appliance 10 is carried out by expanding the spacer body 22 in the lateral direction in a manner to space the inward bent ends 24 from each other, and then fitting the inward bent ends 24 of the spacer body 22 in the circular portions 16 of the through-holes 14 and also fit the projections 26 in the stem portions 18 of the holes 14. When an operator releases its hold from the spacer 20 after the engagement therebetween is completed, the projections 26 of the spacer 20 pass through the stem portions 18 of the through-holes 14 of the casing 12 to allow the spacer 20 to be rotatably mounted with respect to the heating appliance 10.

In the illustrated embodiment, as described above, the through-holes 14 and the combination of the inward bent portions 24 of the spacer body 22 and the projections 26 each are formed into an upright mushroom shape. However, these are not limited to such a mushroom shape as long as the spacer is mounted to the heating appliance with a certain directional property and unexpected release of the engagement between the spacer and the through-holes 14 is effectively prevented.

Figure 4:
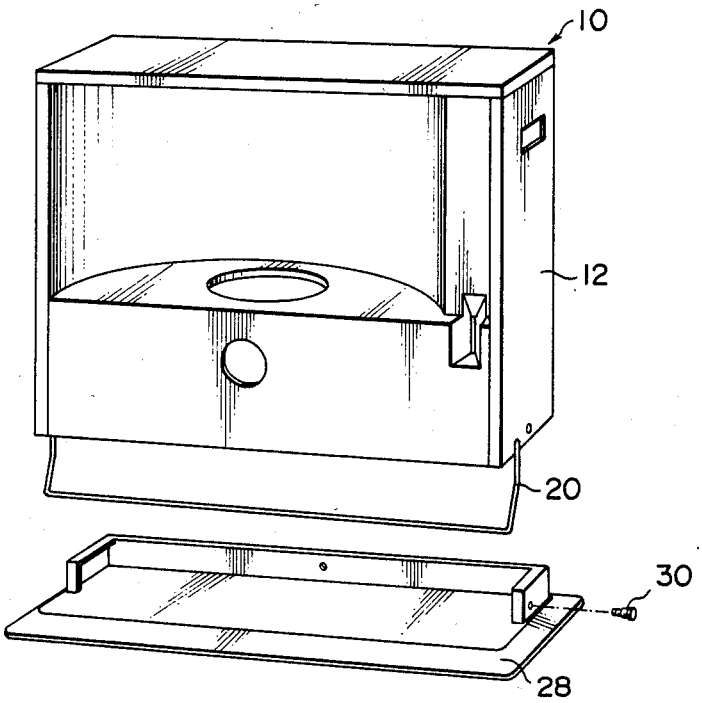
FIG. 4 is an exploded perspective view showing the mounting of a spacer of a spacer structure according to the present invention to a heating appliance.

Reference numeral 28 designates a saucer on which the heating appliance 10 is adapted to be securely put through the bottom portion thereof. The saucer 28 is formed to somewhat outward extend at the periphery thereof from the casing 12 so that the saucer 28 may effectively prevent the spacer 20 from rotating in the downward direction when the heating appliance is securely put on the saucer 28 after the mounting of the spacer 20 to the heating appliance 10, as shown in FIG. 4. This effectively prevents release of the spacer from the through-holes 14 of the casing 12. The secure putting of the heating appliance 10 on the saucer 28 may be carried out in such a manner as widely known in the art, for example, by means of a screw 30, as shown in FIG. 4. The secure putting of the heating appliance 10 on the saucer 28, as described above, causes the spacer 20 to abut against the saucer 28, to thereby prevent the downward rotation of the spacer 20. This results in the spacer 20 positively exhibiting a spacing action and the disengagement of the spacer 20 from the heating appliance being effectively prevented 10.

In the illustrated embodiment, the spacer body 22 is formed at both leg portions thereof into an upward bent dog-legged shape to more positively ensure the engagement between the spacer body 22 and the saucer 28 and exhibit a more effective spacing action.

Reference numerals 32 and 34 (FIG. 1) indicate a combustion cylinder of the oil-fired space heater 10 and a safe guard, respectively.

Figure 5:
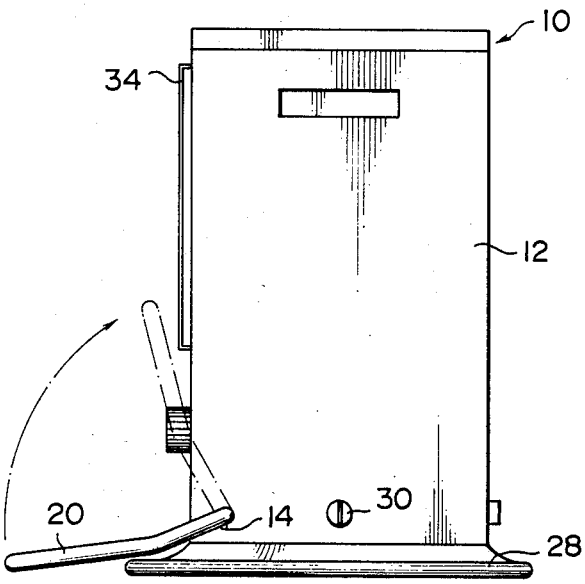
FIG. 5 is a side elevation view showing the manner of pivotally moving a spacer of a spacer structure according to the present invention toward the front face of a heating appliance when the heating appliance is to be packaged.

As described above, the spacer structure of the present invention is adapted to prevent the spacer 20 from being released from the heating appliance 10, when the heating appliance 10 is securely put on the saucer 28 after the inward bent ends 24 of the spacer body 22 and the projections 26 are engaged with the through-holes 14. Further, the spacer 20 is formed of a wire and rotatably mounted to the casing 12 of the heating appliance 10 except in the downward direction from the saucer 28. Thus, when the heating appliance 10 is to be packaged, the spacer 20 may be moved to the front face of the heating appliance 10 as indicated in phantom lines in FIG. 5, resulting in the packaging being simply carried out and small-sized. When the heating appliance 10 is to be used, the spacer 20 is downward moved to the position indicated in solid line in FIG. 5. This allows the spacer 20 to effectively space the heating appliance 10 from a combustible material such as furniture, a wall or the like, because the spacer 20 is adapted to interpose between the appliance 10 and the combustible material.

Thus, it will be readily noted that the present invention may allow the package of the heating appliance to be significantly simplified and small-sized to carry out reduction of the cost, be manufactured with a low cost, and effectively space a heating appliance from a combustible material, without substantially affecting the construction of the heating appliance.

It will thus be seen that the objects set forth above, and those made apparent from the preceding description, are effectively attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A spacer structure for a heating appliance comprising:

an outer casing of said heating appliance having a pair of through-holes formed at the lower portions of opposite side walls thereof;

a spacer comprising a spacer body of a rigid material formed into a substantially U-shape and a pair of mounting means for engagement with said through-holes of said outer casing of said heating appliance to rotatably securely mount said spacer body to said heating appliance;

a saucer on which said heating appliance is adapted to be securely put, said saucer having a periphery outward extending from said heating appliance to a degree sufficient to engage said spacer body when said saucer is attached to said heating appliance; and, means for preventing release of the engagement between said mounting means of said spacer and said through-holes of said outer casing when said spacer body is engaged by said saucer and for allowing said release when said saucer is not attached to said heating appliance.

2. A spacer structure for a heating appliance as defined in claim 1, wherein said pair of said mounting means of said spacer comprise inward bent portions formed at both ends of said spacer body so as to be opposite to each other and projections formed at said inward bent portions, the combination of said inward bent portion and said projection having a contour corresponding to said through-hole of said side wall of said outer casing so as to be integrally fitted in said through-hole.

3. A spacer structure for a heating appliance as defined in claim 2, wherein said through-holes each are formed into a substantially mushroom shape.

4. A spacer structure for a heating appliance as defined in claim 3, wherein said through-holes each are formed with said mushroom shape substantially upright.

5. A spacer structure for a heating appliance as defined in claim 1, wherein said spacer body is formed at the leg portions of said U-shape into an upward bent shape to provide dog-legged leg portions.

6. A spacer structure for a heating appliance as defined in claim 1, wherein said spacer body is formed of a rigid metallic wire.

7. A spacer structure for a heating appliance as defined in claim 1, wherein said spacer body is formed of a rigid plastic wire.

8. A spacer structure for a heating appliance as defined in claim 1, wherein the engagement between said pair of mounting means and said through-holes is such that said spacer body can be pivoted toward the front face of the heating appliance when said heating appliance is to be packaged.

9. A spacer structure for a heating appliance as defined in claim 3, wherein said mushroom shape has a substantially circular portion for receiving said inward bent portion, and a stem portion extending from said substantially circular portion for passing said projection when it is aligned with said stem portion.

10. A spacer structure for a heating appliance as defined in claim 9, wherein said stem portion extends downwardly from said substantially circular portion.

11. A spacer structure for a heating appliance as defined in claim 1, wherein said pair of mounting means of said spacer comprise end portions formed at both ends of said spacer body so as to pass through a directional shape of said through-holes, each of said end portions having a directional shape corresponding to and smaller than the directional shape of said through-holes, the directional shape of said through-holes relative to the directional shape of said end portions preventing release of the engagement between said mounting means of said spacer and said through-holes of said outer casing unless the directional shape of said end portions is aligned with the directional shape of said through-holes.

12. A spacer structure for a heating appliance comprising:

an outer casing of said heating appliance having a pair of through-holes formed at the lower portions of opposite side walls thereof into a substantially upright mushroom shape;

a spacer comprising a spacer body of a rigid material formed into a substantially U-shape and a pair of mounting means for engagement with said through-holes of said outer casing to rotatably securely mount said spacer body to said heating appliance, said pair of said mounting means of said spacer comprising inward bent portions formed at both ends of said spacer body so as to be opposite to each other;

a saucer on which said heating appliance is adapted to be securely put, said saucer having a periphery outward extending from said heating appliance to a degree sufficient to engage said spacer body when said saucer is attached to said heating appliance; and, means for preventing release of the engagement between said mounting means of said spacer and said through-holes of said outer casing when said spacer body is engaged by said saucer and for allowing said release when said saucer is not attached to said heating appliance, said release preventing means including projections formed at said inward bent portions such that the combination of said inward bent portion and said projection has a contour corresponding generally to the mushroom shape of said through-hole and said projections can be aligned to pass through said through-holes when said saucer is not attached to said heating appliance.

* * * * *